US006530100B2

(12) United States Patent
Conrath

(10) Patent No.: US 6,530,100 B2
(45) Date of Patent: Mar. 11, 2003

(54) APPLIANCE SPIN CONTROL AND METHOD ADAPTABLE TO FLOOR STRUCTURE

(75) Inventor: Richard L. Conrath, Herrin, IL (US)

(73) Assignee: Maytag Corporation, Newton, IA (US)

( * ) Notice: Subject to any disclaimer, the term of this patent is extended or adjusted under 35 U.S.C. 154(b) by 92 days.

(21) Appl. No.: 09/885,625

(22) Filed: Jun. 20, 2001

(65) Prior Publication Data

US 2002/0194682 A1 Dec. 26, 2002

(51) Int. Cl.[7] ..... D06F 33/02
(52) U.S. Cl. ..... 8/159; 68/12.06
(58) Field of Search ..... 8/159; 68/12.06

(56) References Cited

U.S. PATENT DOCUMENTS 2,950,009 A * 8/1960 Bochan ..... 68/12.06
3,088,593 A 5/1963 Stilwell, Jr.
3,098,372 A 7/1963 Bochan
3,674,419 A 7/1972 Tichy
4,411,664 A * 10/1983 Rickard et al. ..... 68/12.06 X
4,513,464 A 4/1985 Rettich et al.
4,765,161 A * 8/1988 Williamson ..... 68/12.06
5,375,282 A * 12/1994 Dausch et al. ..... 68/12.06 X
5,720,066 A 2/1998 Kim
5,765,402 A * 6/1998 Ikeda et al. ..... 12/12.06
5,930,855 A 8/1999 Vande Haar et al.
5,970,555 A 10/1999 Baek et al.
6,134,926 A 10/2000 Vande Haar et al.
6,477,867 B1 * 11/2002 Collecutt et al. ..... 68/12.06

* cited by examiner

*Primary Examiner*—Philip R. Coe
(74) *Attorney, Agent, or Firm*—McKee, Voorhees & Sease, P.L.C.

(57) ABSTRACT

A washing machine spin balancing control includes a sensor for sensing vibration of the washing machine cabinet. The floor permits the cabinet to vibrate during the rotation of the basket, the controller senses this vibration and reduces the speed of the basket in response to the vibration caused by imperfections in the floor.

8 Claims, 4 Drawing Sheets

APPLIANCE SPIN CONTROL AND METHOD ADAPTABLE TO FLOOR STRUCTURE

BACKGROUND OF THE INVENTION

The present invention relates to an appliance spin control and method adaptable to floor structure.

Washing machine appliances include washing baskets that spin about a basket axis during one or more washing machine cycles. Weak, unstable or unlevel supporting floors often cause a washing machine to become unbalanced, and therefore it is necessary to provide a system which compensates for a lack of rigidity, stability, or levelness of the floor below the machine. Because the floor condition will vary from one washing machine installation to another, it is desired in accordance with the present invention to have the machine automatically adjust the rotational speed of the basket in relation to the characteristics of the supporting floor.

Therefore a primary object of the present invention is the provision of an improved appliance spin control and method which automatically adjusts the spin of the washing basket in response to the particular characteristics of the supporting floor structure.

A further object of the present invention is the provision of a spin balance control that utilizes a vibration sensor attached to the washing machine cabinet for sensing the vibration of the cabinet during rotation of the washing machine basket.

A further object of the present invention is the provision of a spin control which adjusts the rotational speed of the basket to prevent unbalance vibration for each variation of supporting floor structure.

A further object of the present invention is the provision of an improved appliance spin control and method which are economical in manufacture, durable in use, and efficient in operation.

BRIEF SUMMARY OF THE INVENTION

The foregoing objects may be achieved by a washing machine spin balancing system comprising in combination a support floor and a washing machine cabinet supported on the support floor. A washing machine basket is mounted within the cabinet for rotation about a basket axis. A drive is connected to the basket for causing rotation of the basket. The drive is capable of rotating the basket at a high rotational speed or alternative at one or more low rotational speeds slower than the high rotational speed. A vibration sensor is attached to the cabinet for sensing the vibration of the cabinet. A controller is connected to the sensor and to the drive. The controller is adapted to cause the drive to rotate the basket at the high rotation speed in response to the vibration sensor sensing less than a predetermined amount of vibration of the cabinet. The controller is adapted to cause the drive to rotate the basket at a low rotational speed in response to the vibration sensor sensing more than the predetermined amount of vibration of the cabinet.

According to one feature of the invention the vibration sensor comprises an accelerometer. However, the particular structure of the accelerometer or vibration sensor may vary without detracting from the invention. All that is required is that the vibration sensor be capable of sensing the vibration of the washing machine cabinet.

According to another feature of the invention, the slower rotational speed is approximately 67% of the higher rotational speed.

The foregoing control system permits the reduction of the rotational speed of the basket in response to various types of floors. A floor with imperfections causes the threshold unbalance vibration to be reached more easily at the higher rotational speed than would be the case if the floor were without these imperfections.

According to another feature of the invention, the method comprises placing the washing machine cabinet on a floor having unique characteristics of stability, strength, and levelness which affect the magnitude of vibration of the washing machine cabinet in response to rotation of the basket within the washing machine cabinet. A drive is used to rotate the washing machine basket at a first rotational speed. During rotation a sensor senses the magnitude of vibration of the washing machine cabinet. A controller connected to the vibration sensor and to the drive causes the drive to reduce the rotational speed of the basket to a second rotational speed slower than the first rotational speed in response to the sensed magnitude of vibration of the washing machine basket exceeding a predetermined magnitude of vibration.

DETAILED DESCRIPTION OF THE INVENTION

Figure 1:
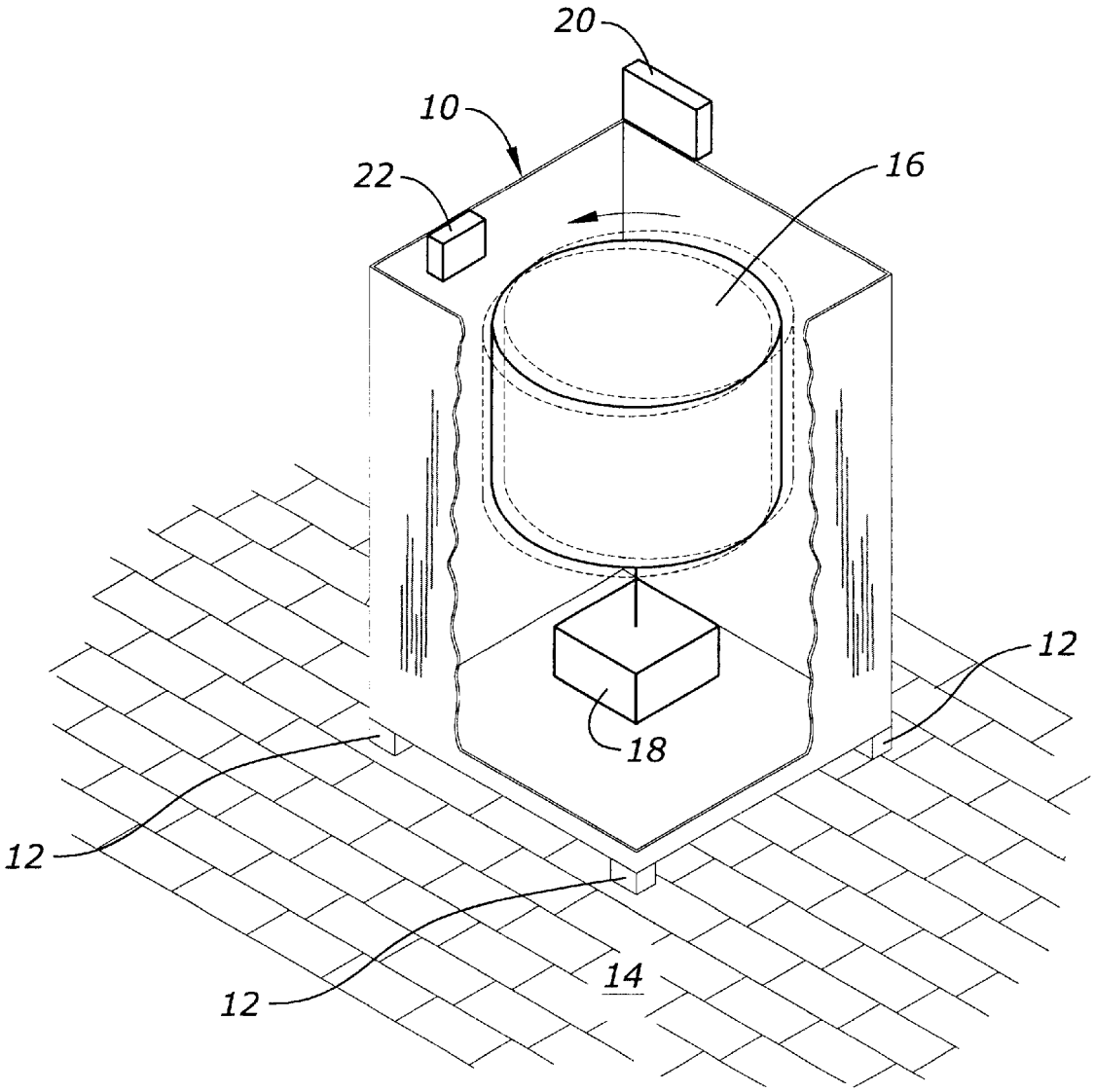
FIG. 1 is a schematic pictorial view of a washing machine having a rotatable washing machine basket therein.

Referring to the drawings the numeral 10 designates a washing machine cabinet. Cabinet 10 includes cabinet feet 12 which are shown schematically, and which support the cabinet 10 on a supporting floor 14. The structure of the feet 12 is intended to be shown only in a schematic sense, and various types of supporting legs, feet or devices are used with washing machines to support the washing machine cabinet on a supporting floor.

Many supporting floors differ in their characteristics. Some floors are not level. Others are weak and likely to vibrate in response to vibration of the cabinet. Others may have depressions or other weak parts which cause the cabinet 10 to vibrate more easily than would be the case if the cabinet were supported on a level sturdy floor.

A basket 16 is rotatably mounted with the cabinet 10 and is driven by a drive motor 18 shown schematically in FIG. 1. Mounted on the cabinet 10 is a controller 20 for controlling the drive motor. Also mounted on the cabinet 10 is a sensor box 22. Within sensor box 22 is a sensor 24 which is adapted to sense the vibration of the cabinet 10.

Figure 2:
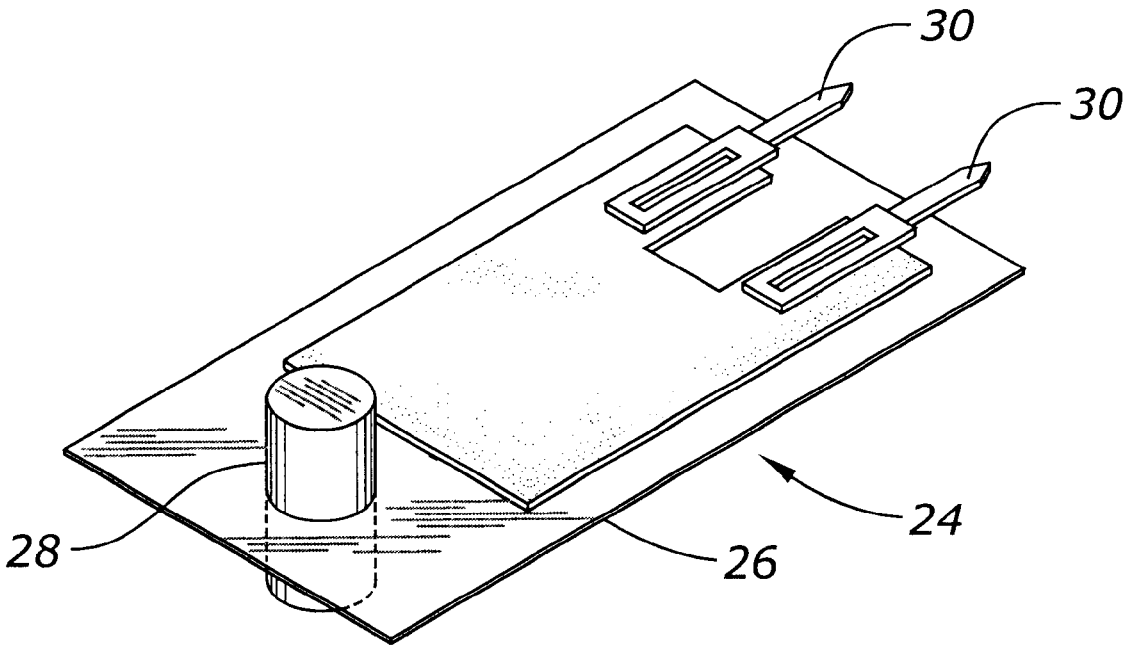
FIG. 2 is a pictorial view of an example of an accelerometer that may be used with the present invention.

The preferred vibration sensor 24 is an accelerometer such as shown in FIG. 2. The accelerometer 24 in FIG. 2 is electronically connected to the controller 20 and is mounted on cabinet 10 to sense machine vibration. Although the accelerometer can be positioned in a variety of different locations about the washing machine cabinet 10, mounting the accelerometer 24 toward the top of the washing machine cabinet 10 has been found to produce the most reliable results. The accelerometer includes a piezoelectric film 26 with a mass 28 attached to the end of the film 26. Leads 30 are also attached to the film 26. The accelerometer 24 is well suited for measuring vibration because acceleration of the mass 28 and the vibration of the cabinet 10 are proportional. The accelerometer 24 shown in FIG. 2 is only an example, and other forms of accelerometers or vibration sensors may be used without detracting from the invention.

Figure 3:
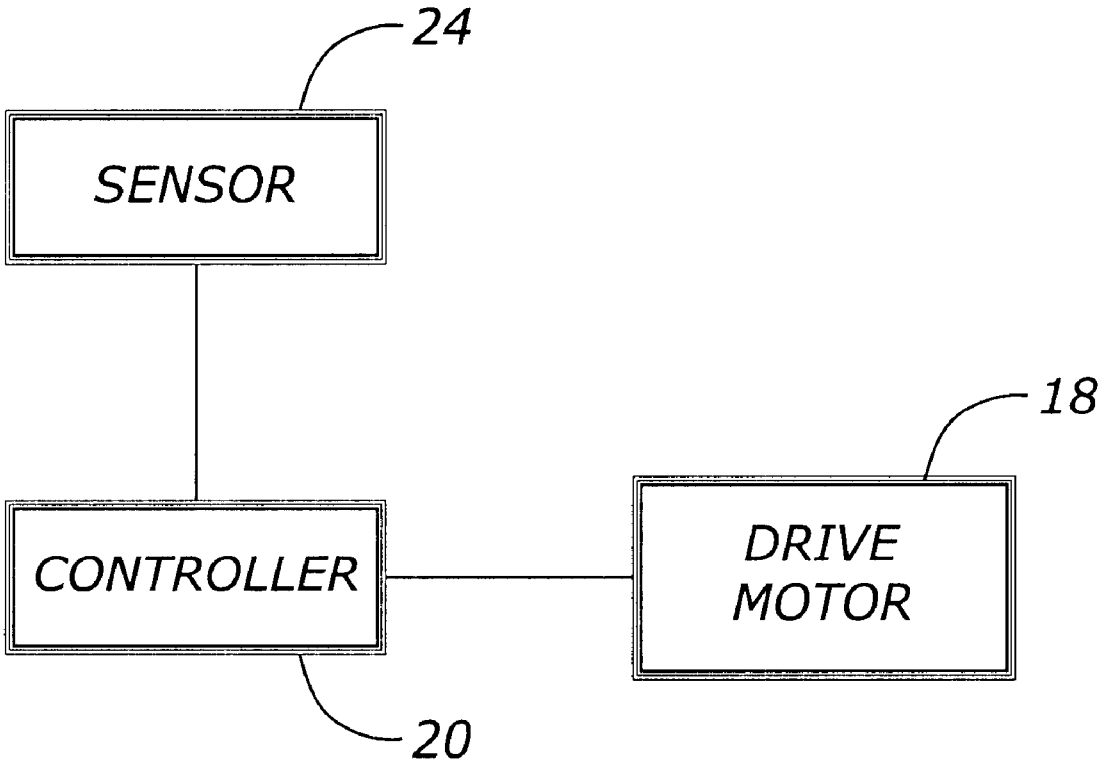
FIG. 3 is a block diagram showing the interrelationship of the sensor, the controller and the drive motor.

Referring to FIG. 3 the sensor or accelerometer 24 is connected electrically to the controller 20, and the controller 20 is also connected to the drive motor 18. Drive motor 18 is adapted to rotate the basket 16 at two or more different speeds. The normal speed is the fastest, but if an unbalance situation arises where the vibration of cabinet 10 is too great then the motor 18 is capable of reducing the rotational speed of the basket to one or more lesser speeds.

Figure 4:
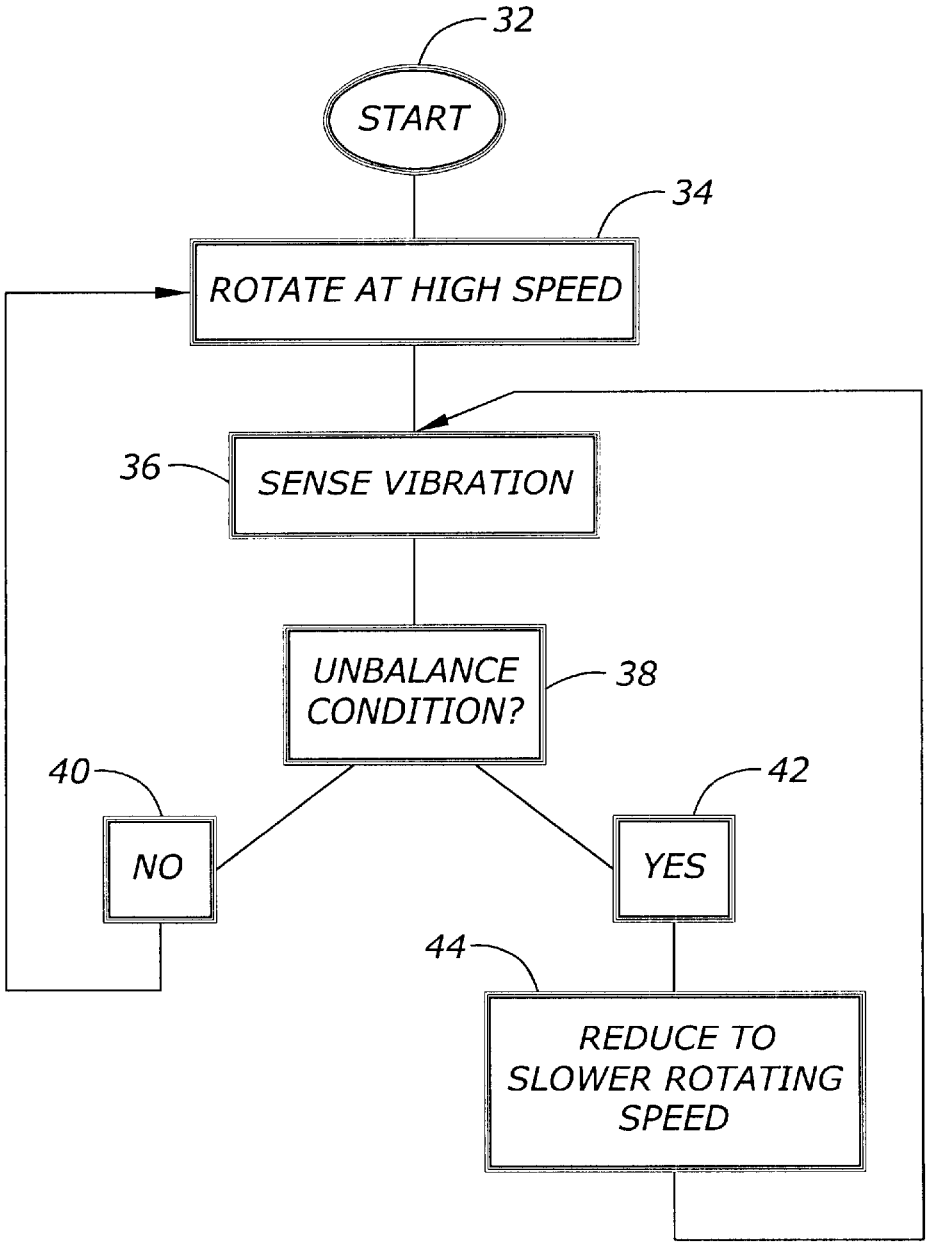
FIG. 4 is a flow diagram showing the method for controlling rotational speed of the basket.

FIG. 4 shows a flow diagram of the method of the present invention. The numeral 32 refers to the start of the method. After the start the motor 18 rotates the basket 16 at its normal high speed. This step is identified by the numeral 34.

The numeral 36 refers to the sensing of the vibration of the cabinet 10 by means of the accelerometer 24. The numeral 38 refers to the analysis done by the controller 20 to determine whether or not the sensed vibration exceeds a predetermined magnitude representing undesirable unbalance situations. The numeral 40 represents a "no" analysis that the vibration is below the unbalance condition. In that situation the controller 20 causes the motor 18 to continue rotating the basket 16 at its highest speed.

However, if an unbalance condition is sensed at any time during the rotation of the device, as represented by the numeral 42, the controller automatically causes the drive 18 to reduce the rotational speed of the basket to a slower rotating speed. There may be only a single slower rotating speed, or there may be multiple rotating speeds in descending order, all less than the initial rotating speed represented by the numeral 34.

During the rotation at the slower speed, the accelerometer continues to sense the vibration of the machine, and if the vibration ceases, the controller can again initiate the rotation of the basket 16 at the faster speed.

The controller may set so that it continues at the slower speed, or it can be set so that after a pre-determined time frame it could retry to attain the faster speed. As it accelerates from the slower speed to the faster speed, the sensor may sense the vibration and switch back to the slower speed. It is not required that the faster speed be used for adequate performance.

The advantage of the present invention is that the controller automatically adjusts the rotational speed of the basket 16 in relation to the type of floor 14 upon which the cabinet 10 is supported. If the floor is weak or not level, the vibration sensed by the sensor 24 reaches the predetermined unbalance condition very easily, thereby causing the controller to reduce the speed of the basket. On other floors that provide a better supporting surface, there may be little or no sensing of an unbalance condition, and the basket continues to rotate at its higher speed. Furthermore, if at some time during the spin cycle the contents of the basket 16 become unevenly distributed, an unbalance condition may arise, and the controller will automatically reduce the speed of the basket during this temporary unbalance condition.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A washing machine spin balancing system comprising:

a support floor;

a washing machine cabinet on said support floor;

a washing machine basket mounted within said cabinet for rotation about a basket axis;

a drive connected to said basket for causing rotation of said basket, said drive being capable of rotating said basket at a high rotational speed or alternatively at a low rotational speed which is slower than said high rotational speed;

a vibration sensor attached to said cabinet for sensing vibration of said cabinet;

a controller connected to said sensor and to said drive, said controller being adapted to cause said drive to rotate said basket at said high rotational speed in response to said vibration sensor sensing less than a predetermined amount of vibration of said cabinet, said controller being adapted to cause said drive to rotate said basket at said low rotational speed in response to said vibrations sensor sensing more than said predetermined amount of vibration of said cabinet.

2. A washing machine spin balancing system according to claim 1 wherein said vibration sensor comprises an accelerometer.

3. A washing machine spin balancing system according to claim 1 wherein said slower rotational speed is approximately 67% of said higher rotational speed.

4. A washing machine spin balancing system according to claim 1 wherein said floor comprises imperfections which cause said predetermined amount of vibration to be reached more easily at said higher rotational speed compared to another floor without said imperfections.

5. A method for adjusting the rotational speed of a washing machine basket within a washing machine cabinet in relation to floor variability, said method comprising:

placing said washing machine cabinet on a floor having unique characteristics of stability, strength, and levelness which affect the magnitude of vibration of said washing machine cabinet in response to rotation of said basket within said washing machine cabinet;

using a drive to rotate said washing machine basket at a first rotational speed;

sensing the magnitude of vibration of said washing machine cabinet with a vibration sensor;

using a controller connected to said vibration sensor and said drive to cause said drive to reduce the rotational speed of said basket to a second rotational speed slower than said first rotational speed in response to said sensed magnitude of vibration of said washing machine basket exceeding a predetermined magnitude of vibration.

6. A method according to claim 5 characterized by performing said sensing step with an accelerometer engaging said washing machine cabinet.

7. A method according to claim 6 characterized by reducing said rotational speed of said basket to a second rotational speed approximately 67% of said first rotational speed in response to said sensed magnitude of vibration being greater than said predetermined magnitude.

8. A method according to claim 5 and further comprising using said controller to cause said drive to resume said first rotational speed of said basket when said sensed magnitude of vibration of said washing machine basket is lower than said second predetermined magnitude of vibration.

* * * * *